US005409138A

United States Patent [19]

Nakano

[11] Patent Number: 5,409,138

[45] Date of Patent: Apr. 25, 1995

[54] LIQUID SUPPLY DEVICE

[75] Inventor: Hiroshi Nakano, Nagoya, Japan

[73] Assignee: Brother Kogyo Kabushiki Kaisha, Nagoya, Japan

[21] Appl. No.: 93,583

[22] Filed: Jul. 19, 1993

[30] Foreign Application Priority Data

Sep. 22, 1992 [JP] Japan ..... 4-252866

[51] Int. Cl.[6] ..... F15D 1/00; B41J 2/175

[52] U.S. Cl. ..... 222/64; 222/189.06; 222/196; 222/DIG. 1; 347/85; 347/87

[58] Field of Search ..... 222/64, 189, 196, DIG. 1; 347/85, 87, 93

[56] References Cited

U.S. PATENT DOCUMENTS

| | | | |
|---|---|---|---|
| 519,478 | 5/1894 | Schlueter | 222/189 |
| 2,221,487 | 11/1940 | Moore | 222/189 X |
| 3,104,487 | 9/1963 | Von Funk | 222/189 |
| 3,953,862 | 4/1976 | Amberntsson et al. | 347/87 |
| 5,010,354 | 4/1991 | Cowger et al. | 347/87 |

FOREIGN PATENT DOCUMENTS

| | | | |
|---|---|---|---|
| 747088 | 11/1966 | Canada | 222/189 |
| 88292 | 9/1983 | European Pat. Off. | 347/87 |
| 562733 | 9/1993 | European Pat. Off. | 347/87 |
| 1203215 | 1/1960 | France | 222/64 |
| 3640032 | 5/1988 | Germany | 347/87 |
| 362039247 | 2/1987 | Japan | 347/93 |

*Primary Examiner*—Andres Kashnikow
*Assistant Examiner*—Anthoula Pomrening
*Attorney, Agent, or Firm*—Oliff & Berridge

[57] ABSTRACT

An ink filter having a fine mesh structure secured to an ink supply passageway is erected at a side portion of an ink reservoir. An upper portion of the ink reservoir communicates with the atmosphere through an air filter, a lower side portion communicates with the ink supply passageway. An ink filter interrupts the ink supply passageway at an upper portion and has a predetermined height to ensure maintenance of a column of ink in the ink supply passageway. As a result of the capillary phenomenon of the ink filter on the ink, the ink fills the entire portion of the ink supply passageway located below the ink filter so that the liquid surface of the ink is above the communication portion between the ink supply passageway and the ink reservoir but below the position of the ink filter.

11 Claims, 3 Drawing Sheets

LIQUID SUPPLY DEVICE

BACKGROUND OF THE INVENTION

1. Field of the Invention

This invention relates to a liquid supply device.

2. Description of the Related Art

Dust, such as rubbish and trash, frequently gets into a liquid medium which is supplied to a liquid reservoir to contaminate the reservoir. Thus, there has been conventionally used a liquid supply device that is equipped with a mesh filter, for excluding the dust from the liquid medium, in a supply passageway through which the liquid medium is supplied to the liquid reservoir, thereby supplying only the liquid medium into the liquid reservoir while excluding the dust.

The liquid supply device as described above will be hereunder described in detail (with reference to FIG. 4) in the case of an ink supply device 50 used for a ink jet printer.

The ink supply device 50 comprises an ink tank 46 for storing supplied ink 43*a*, a pump 47 for drawing the ink 43*a* stored in the ink tank 46 into a cylinder 52, through a check-valve 51*a*, by driving a piston 53. The ink 43*a* is pushed from the cylinder 52 through a check-valve 51*b* into a tube 49 which serves to guide the ink 43*a* to an ink reserving chamber (hereinafter referred to as "ink reservoir") 44 of an ink jetting head 40. An ink filter 48 for removing dust from the ink 43*a*, which is guided by the tube 49 and supplied into the ink reservoir 44, is located at the end of tube 49 and at the entrance to ink reservoir 44.

The ink jetting head 40 of the ink jet printer, to which the ink is supplied by the ink supply device 50, is formed with an orifice 41 having about a 50-micron diameter. The ink stored in the ink reservoir 44 is ejected through the orifice 41 by vibration of a piezo-vibrator 42.

When the ink 43 stored in the ink reservoir 44 is contaminated by dust, the orifice 41 becomes choked with the dust to degrade the printing operation. Accordingly, the ink reservoir 44 is supplied with the ink 43 that has been filtered to remove the dust to improve the printing operation. The ink reservoir 44 communicates with the atmosphere through an air filter 45. Thus, the inside of the ink reservoir 44 is kept at approximately atmospheric pressure to stabilize the ink supply thereto. In addition, dust in the atmosphere is prevented from contaminating the ink 43 of the ink reservoir 44 by air filter 45.

On the other hand, in order to surely exclude dust, whose particle size exceeds the size of the orifice 41, the ink filter 48 is so designed as to have holes of about 10-micron size. Therefore, it takes a long time for the ink 43 to pass through the ink filter 48. If the ink supply speed of the ink 43 which is supplied into the ink reservoir 44 is lower than the speed at which the ink 43 is consumed by the printing operation, then a point will be reached where there is no ink 43 in the ink reservoir 44 and the printing operation will be interrupted until the ink 43 can be sufficiently supplied to the ink reservoir 44.

In order to prevent this interruption of the printing operation, in the conventional ink supply device 50, the ink 43 is rapidly passed through the ink filter 48 by the use of a pumping force of the pump 47.

Therefore, in order to rapidly pass the dust-excluded liquid ink 43 into the ink reservoir 44, the conventional technique has required a device such as the pump 47, or the like, for rapidly passing the liquid ink with a resultant complicated structure.

In addition, there is a requirement for a power source for driving a device such as the pump 47 or the like. There is another problem in that the size of the structure of the ink jet printer can not be miniaturized due to the necessary driving mechanism for the piston (not shown) and the pump 47 having to have a driving source.

SUMMARY OF THE INVENTION

This invention has been implemented to solve the above problems. The invention has an object to provide a liquid supply device capable of rapidly supplying dust-excluded liquid medium into a liquid reservoir that does not use a pump or similar feed device.

In order to attain the above object, the liquid supply device of this invention includes a liquid reservoir which communicates with the atmosphere and stores supplied liquid, a liquid supply passageway which communicates with the lower portion of the liquid reservoir and has a supply port for the supplied medium at the upper portion thereof, and a mesh-shaped filter which is disposed at a higher position than a communication portion between the liquid supply passageway and the liquid reservoir so as to interrupt the liquid supply passageway.

According to the liquid supply device of this invention thus structured, when the liquid is supplied through the supply port, no pull-out force of the liquid surface by capillary phenomenon of a filter portion occurs when the liquid surface is located above the filter. The supplied liquid passes through the filter by gravity action of the liquid in the liquid supply passageway which is located above the liquid surface of the liquid reservoir. The passed liquid is then supplied from the liquid supply passageway into the liquid reservoir.

As is apparent from the above description, according to the liquid supply device of this invention, the dust-excluded liquid medium can be rapidly supplied into the liquid reservoir without a pump or similar feed device.

BRIEF DESCRIPTION OF THE DRAWINGS

A preferred embodiment of the invention will be described with reference to the accompanying drawings in which:

FIG. 2(*b*) is a front view showing the structure of the ink filter;

DETAILED DESCRIPTION OF THE PREFERRED EMBODIMENTS

Figure 1:
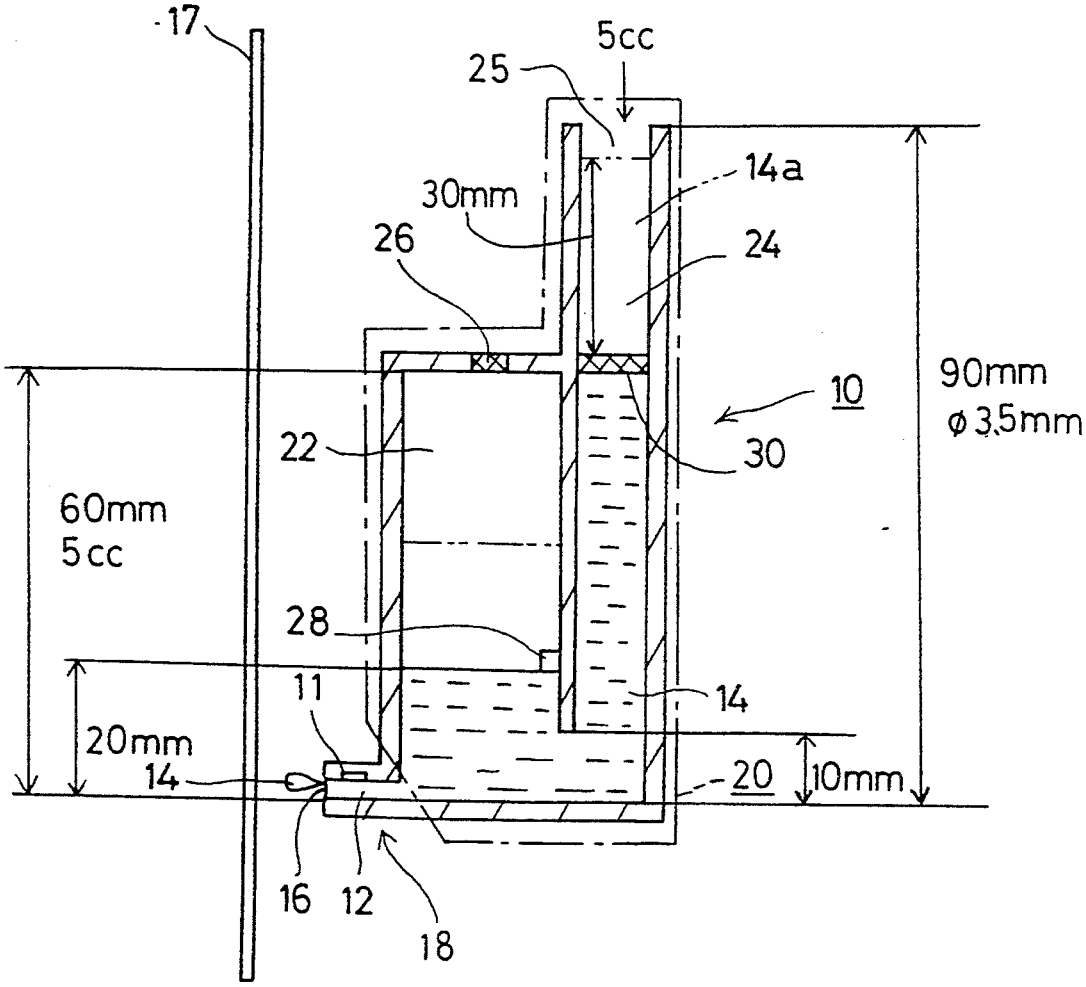
FIG. 1 is a cross-sectional view showing the structure of an ink jetting head.

FIG. 1 is a cross-sectional view of the structure of the ink jetting head 10 that is formed integrally with the ink supply device 20.

The ink jetting head 10 comprises an ink discharge device 18 for discharging ink 14, from an ink chamber 12, onto a recording sheet 17 through an orifice 16, having a 50-micron diameter, in droplet form, and the ink supply device 20 for supplying the ink to the ink discharge device 18.

The ink discharge device 18, that is, the ink chamber 12 and orifice 16, is conventionally well known. Thus, a description will be omitted from the following discussion of the invention.

The ink supply device 20 includes an ink reserving chamber (hereinafter referred to as "ink reservoir") 22 in which the ink 14 to be supplied to the ink chamber 12 is stored, and an ink supply passageway 24 for guiding the ink 14 supplied through an ink supply port 25 to the ink reservoir 22. The ink reservoir 22 and the ink supply passageway 24 are partitioned by a frame of the ink jetting head 10. The ink supply device 20 further includes an ink filter 30 for removing dust, such as rubbish, trash, etc., that might enter into and contaminate the ink 14*a* from the ink 14 in the ink supply passageway 24 below ink filter 30 (in FIG. 1), and an ink detection device 28 for detecting the amount of ink 14 which is held in the ink reservoir 22.

The ink reservoir 22 is 60 mm in inside height, that is, from the bottom surface to the ceiling surface, and has a 5 cc volume. The ink reservoir 22 partially communicates with the air atmosphere at an upper portion so that the inside pressure of the ink reservoir 22 is kept to the same pressure as the atmosphere. In addition, an air filter 26 is provided at the communication portion between the ink reservoir 22 and the atmosphere to prevent dust from getting into the ink reservoir 22.

The ink reservoir 22 also communicates with the lower side portion of the ink supply passageway 24 at a side portion that extends from the bottom surface of the ink reservoir 22 for a height of 10 mm to supply the ink 14 from the ink supply passageway 24 to the ink reservoir 22. The ink detection device 28 is positioned 20 mm above the bottom surface of the ink reservoir 22. It serves to detect the liquid surface of the ink 14 inside of the ink reservoir 22 to determine a time when supply of the ink 14 is required.

The ink supply passageway 24 comprises a substantially cylindrical space which is partitioned at the side of the ink reservoir 22. The ink supply passageway has a diameter of about 3.5 mm and is about 90 mm in height. As described above, the ink supply passageway 24 is intercommunicated with the lower side portion of the ink reservoir 22 to direct the ink 14 into the ink reservoir 22, the ink 14 initially supplied from the ink supply port 25.

Figure 2A:
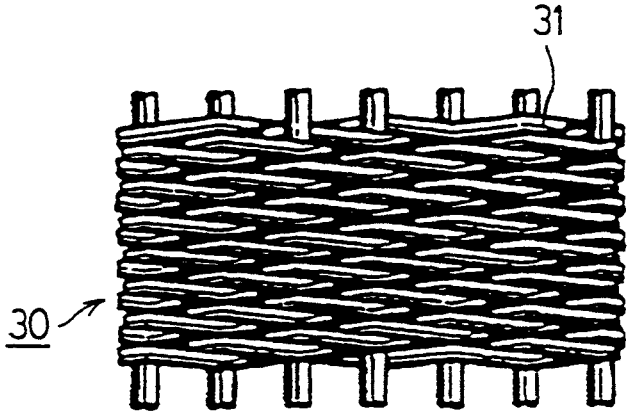
FIG. 2(*a*) is a plan view showing the structure of an ink filter.
Figure 2B:
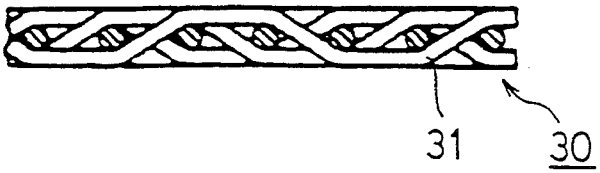

As shown in FIG. 2, the ink filter 30 is formed by a so-called "Twill Dutch Weave" knitting in which four kinds of weave wires, which are upwardly and downwardly alternated two by two, are intertwisted around equi-distantly disposed knitting rods. That is, a stainless wire 31 having about 50-micron diameter is knitted to form a mesh of about 10 microns, a size that is sufficiently smaller than the 50 micron diameter of the orifice 16.

The ink filter 30 thus formed is substantially horizontally disposed at a position 60 mm in height from the bottom surface of the ink supply passageway 24, that is, at the same height position as the ceiling surface of the ink reservoir so as to interrupt the ink supply passageway 24, whereby dust whose particle size exceeds about 10 microns can be removed from the ink 14*a* as it passes through the ink filter 30. When the ink 14*a* is supplied, the ink filter 30 can hold the ink 14 in the ink supply passageway 24 so that the liquid surface of the ink 14 inside of the ink supply passageway 24 is disposed at the position of the ink filter 30 at all times. The ink 14 is pulled up to the ink filter 30 in a manner to be described. This holding effect is obtained by the capillary phenomenon of the ink 14 caused by the 10-micron meshes of the ink filter 30.

Figure 3:
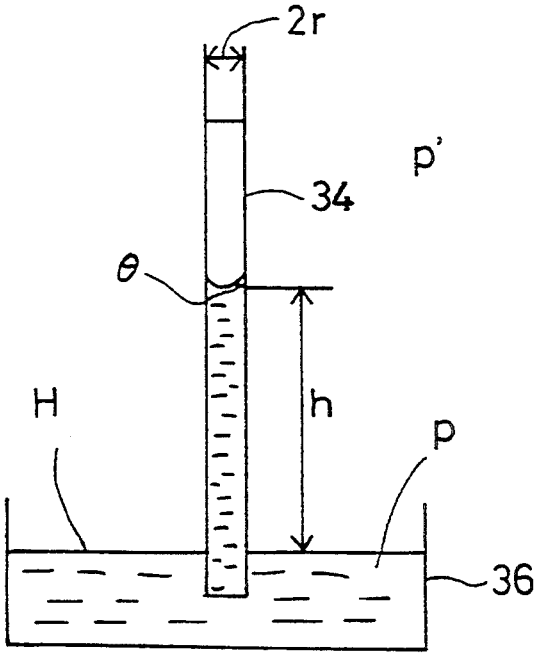
FIG. 3 is a detailed explanatory diagram for the capillary phenomenon which is used in this invention.
Figure 4:
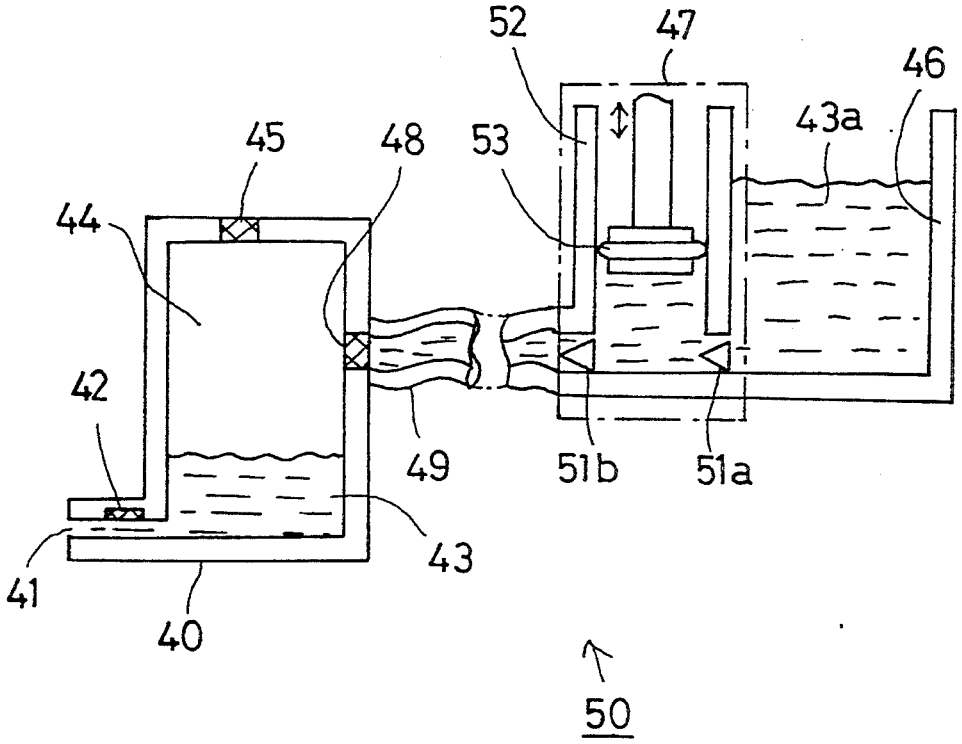
Fig.4 RELATED ART
FIG. 4 is a cross-sectional view showing the structure of an ink supply device used in a conventional ink jet printer.

This capillary phenomenon will now be described. As shown in FIG. 3, the capillary phenomenon is defined as a phenomenon that when a fine capillary tube is erected in the liquid of a tank 36, the liquid surface in the capillary tube 34 rises up to a position higher than the liquid surface in the tank 36 because of the surface tension of the liquid. Representing the difference in height between the rise-up liquid surface in the capillary tube and the liquid surface in the water tank 36 by h, it has been known that the relationship as represented by the following equation is satisfied for h:

$$h=2H\cos\theta/r(p-p')$$

Here, H represents the surface tension of liquid, $\theta$ represents a contact angle between the wall surface of the capillary tube 34 and the liquid surface, r represents radius of capillary tube 34, p represents density of liquid, and p' represents density of air.

From this relationship, it is apparent that the liquid surface in the capillary tube 34 rises to a higher level than the liquid surface in the liquid tank 36 as the radius r of the capillary tube 34 decreases.

On the basis of this phenomenon, the ink filter 30 is positioned in the ink supply passageway 24 so that the liquid surface of the ink 14 in the ink supply passageway 24 is located at the position of the ink filter 30.

Next, a method of supplying the ink 14 into the ink supply device thus structured will be described.

First, in a state where no ink 14 is supplied into the ink reservoir 22 and the ink supply passageway 24, an injection head of an ink injection jig (not shown) is moved into contact with the ink supply port 25 of the ink supply passageway 24 to inject the ink 14*a* from the injection head into the ink supply passageway 24 in a 5 cc amount. The injected ink 14*a* passes through ink filter 30, and the non-contaminated ink 14 is stored in a bottom portion of the ink reservoir 22 and the ink supply passageway 24 so that the liquid surfaces are at the same height in both the ink reservoir 22 and the ink supply passageway 24 until the intercommunication portion between the ink reservoir 22 and the ink supply passageway 24 is filled with the ink 14. Thereafter, the residual ink 14 is supplied to the ink reservoir 22 while air is left in the ink supply passageway 24 which is located at the lower surface side of the ink filter 30. Even when the ink supply is completed, air exists in the ink supply passageway 24 at the lower surface side of the ink filter 30.

Thereafter, a suction pressure is applied by the injection head, while the injection head of the ink injection jig is closely contacted with the ink supply port 25, so that the air in the ink supply passageway 24 is sucked into the injection head. The liquid surface of the ink 14 in the ink supply passageway 24 rises up in the ink supply passageway 24 to a position higher than the ink filter 30.

Thereafter, when the ink injection jig is detached from the ink supply port 25, the ink 14 that was raised up above the ink filter 30 moves down by gravity, and the liquid surface stops at a position corresponding to the ink filter 30.

When the liquid surface of the ink 14 is at the ink filter 30, as described above, the liquid surface of the ink 14 is prevented from moving to a position lower than the ink filter 30 by the capillary phenomenon of the liquid surface and the mesh of the ink filter 30.

At this time, the dust or particle contaminates contained in the ink 14*a* have been removed by the ink filter 30. The injection amount of ink 14*a* corresponds to two-thirds of the total volume of the portions of the ink reservoir 22 and the ink supply passageway 24 which are located below the position of the ink filter 30. Thus, no ink 14 attaches to the air filter 26 and the air filter 26 does not get choked.

When the ink 14 in the ink supply device 20 is jetted by the ink jetting device 18 through a printing operation, the ink 14 in the ink reservoir 22 is decreased. When the ink 14 in the ink reservoir 22 is decreased and the liquid surface of the ink 14 descends to a position lower than the position where the ink detection device 28 is located, as indicated by a solid line of FIG. 1, the ink detection device 28 is exposed to air and detects the need to supply 1 cc of ink 14*a* from the ink supply port 25.

When the ink 14*a* is added, the liquid surface of the ink 14 in the ink supply passageway 24 rises to a position approximately 3 cm higher than the ink filter 30, as indicated by a two-dotted chain line of FIG. 1. The pull-up force on the liquid surface caused by the capillary phenomenon at the ink filter 30 side vanishes, and the weight of the ink 14*a* in the ink supply passageway 24, at a position higher than the upper surface of the ink 14 in the ink reservoir 22, acts as a force for allowing the ink 14*a* to pass through the ink filter 30.

The supplied ink 14*a* passes through the ink filter 30 while any dust found in the supplied ink 14*a* is removed. In a case of the ink 14 of this embodiment, which has 25 cP (centipoise) viscosity and a 29 dyn/cm surface tension, the supplied ink 14*a* completely passes through the ink filter 30 in about 25 seconds. The passed ink 14 is supplied into the ink reservoir 22, and the liquid surface of the ink reservoir 22 rises to the level indicated by a two-dotted chain line of FIG. 1 to again contact ink detection device 28. On the other hand, the liquid surface of the ink 14 in the ink supply passageway 24 descends to the position of the ink filter 30 and is kept at this position by the capillary phenomenon of the mesh of the ink filter 30.

According to an experiment using the ink 14 of this embodiment, the time required to supply 1 cc of ink 14 into the ink reservoir 22 is a one half, or less, of the time required in a case where the ink is passed through the ink filter 30 by the action of only gravity on the supplied ink 14*a* (in this case, 1.2 minute is required). Accordingly, according to the ink supply device 20 of this embodiment, the ink 14, from which the dust in the supplied ink 14*a* is removed, can be rapidly supplied into the ink reservoir 22 using no pump or the like by a device having a simple structure.

This invention is not limited to the above embodiment, and various modifications may be made without departing from the scope of this invention.

For example, this invention is described representatively using the ink supply device 20 for a ink jet printer. However, this invention is applicable to any liquid supply device for liquids where it is necessary to remove the dust in the supplied liquid and the liquid can be rapidly supplied into a liquid reservoir using the simple device structure. In this case, if the viscosity of the liquid is set to a value different from that of the ink 14 of this embodiment, the time required for the liquid to pass through the (liquid) filter 30 may be different from the time described above. For example, when in place of the ink 14, water (liquid) of 1 cP viscosity is used with the ink supply device 20 of this invention, the time required to supply 1 cc of water is about 1.5 second. As described, lowering the viscosity of the liquid shortens the time required to supply the liquid into the liquid reservoir.

Further, the ink supply passageway 24 may not be designed in a substantially-cylindrical shape. It may be designed in a substantially-prismatic or different shape. In addition, the ink supply passageway 24 is not required to be formed integrally with the ink reservoir 22 in the vicinity of the ink reservoir 22 but may be intercommunicated with the ink reservoir 22 through a tube or the like and the height at which the ink filter 30 is disposed may not be set to be substantially the same height as the ceiling surface of the ink reservoir 22.

Since, irrespective of the variation of the shape of the ink supply passageway 24, the speed of the supply of the constant-amount ink 14 into the ink reservoir 22 is determined by the weight of the ink 14 which is located at a position higher than the liquid surface in the ink reservoir 22, the speed of the ink supply can be increased by disposing the ink filter 30 at a position higher than the ink detection device 28 and the height of the device can be lowered by lowering the height of the ink filter 30.

The ink filter 30 may be designed in any construction, other than the construction described above, insofar as a mesh for allowing only the ink 14 to pass therethrough is formed. In addition, an ink filter 30 whose mesh size is above or below 10 microns may be used.

Further, the ink jetting device does not need to be located adjacent to the ink supply device 20 as is shown in FIG. 1.

What is claimed is:

1. A liquid supply device, including:

a liquid reservoir which communicates with an atmosphere and stores supplied liquid therein;

a liquid supply passageway which communicates with a lower portion of said liquid reservoir and has a supply port for supplying a liquid medium at an upper portion thereof; and a mesh filter disposed at a position higher than a communication portion between said liquid supply passageway and said liquid reservoir so as to interrupt said liquid supply passageway, wherein an upper surface of the liquid in said liquid supply passageway is maintained at the position of said mesh filter by capillary phenomenon.

2. The liquid supply device as claimed in claim 1, further comprising a liquid supply detector mounted in said liquid reservoir, said liquid supply detector detecting that a supply of the liquid in said liquid reservoir is required when the surface of the liquid in said liquid reservoir is positioned lower than a position where the liquid supply detector is mounted.

3. The liquid supply device as claimed in claim 1, wherein said mesh filter removes dust from the liquid as the liquid passes through said mesh filter.

4. The liquid supply device as claimed in claim 1, wherein said mesh filter forms a mesh in which four kinds of weave wires, which are upwardly and downwardly alternated two by two, are intertwisted.

5. A liquid dispensing device, comprising:

a liquid supply passageway, said liquid supply passageway having a liquid supply port at a first end thereof;

a liquid reservoir;

a liquid dispensing portion connected to said liquid reservoir;

a liquid detection device mounted in said liquid reservoir;

a liquid connecting passageway between said liquid supply passageway and said liquid reservoir, wherein said liquid connecting passageway connects a second end of said liquid supply passageway to an end portion of said liquid reservoir; and a first filter mounted in said liquid supply passageway, wherein an upper surface of the liquid in said liquid supply passageway is maintained at a position of said first filter by capillary phenomenon.

6. The liquid dispensing device as claimed in claim 5, further comprising an opening in said liquid reservoir at an end opposite to said end portion at said liquid connecting passageway.

7. The liquid dispensing device as claimed in claim 6, wherein said opening has a second filter mounted therein.

8. The liquid dispensing device as claimed in claim 5, wherein said first filter forms a mesh.

9. The liquid dispensing device as claimed in claim 8, wherein mesh openings of said first filter have a diameter substantially no greater than 10 microns.

10. The liquid dispensing device as claimed in claim 5, wherein said liquid supply passageway and said liquid reservoir have a common wall, said liquid connecting passageway being an opening in said common wall.

11. The liquid dispensing device as claimed in claim 5, wherein said first filter is at a position in said liquid supply passageway so as to be above an upper edge of said liquid connecting passageway.

* * * * *